US008556412B2

(12) United States Patent
Park et al.

(10) Patent No.: US 8,556,412 B2
(45) Date of Patent: Oct. 15, 2013

(54) HANDHELD PRINTER AND PRINTING METHOD THEREOF

(75) Inventors: Sung-bum Park, Seongnam-si (KR); Ji-won Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 633 days.

(21) Appl. No.: 12/562,397

(22) Filed: Sep. 18, 2009

(65) Prior Publication Data

US 2010/0265286 A1 Oct. 21, 2010

(30) Foreign Application Priority Data

Apr. 15, 2009 (KR) ..... 10-2009-0032950

(51) Int. Cl.
*B41J 3/36* (2006.01)

(52) U.S. Cl.
USPC ..... 347/109

(58) Field of Classification Search
CPC ..... B41J 3/36; B41J 3/46
USPC ..... 347/5, 19, 108, 109
See application file for complete search history.

(56) References Cited

U.S. PATENT DOCUMENTS 5,446,559 A * 8/1995 Birk ..... 358/473
6,116,707 A * 9/2000 Avida ..... 346/139 R
6,481,905 B2 * 11/2002 Day et al. ..... 400/88

* cited by examiner

*Primary Examiner* — An Do
(74) *Attorney, Agent, or Firm* — Sughrue Mion, PLLC

(57) ABSTRACT

A handheld printer and a printing method thereof are provided. The handheld printer receives distance information from at least one sensor positioned outside the handheld printer, determines its position based on the distance information, and determines data to be printed in the determined position.

13 Claims, 6 Drawing Sheets

FIG. 6

```
StartPrint();
ConfigurationPrintingRegion();
do
{
        PositionDetection();
        do
        {
                printObject();
        }
        while( checkPrintObject() );
}
while( checkPrintDone() );
EndPrint();
```

HANDHELD PRINTER AND PRINTING METHOD THEREOF

CROSS-REFERENCE TO RELATED PATENT APPLICATION

This application claims the benefit of Korean Patent Application No. 10-2009-0032950, filed on Apr. 15, 2009, in the Korean Intellectual Property Office, the disclosure of which is incorporated herein in its entirety by reference.

BACKGROUND OF THE INVENTION

1. Field of the Invention

The present invention relates to a handheld printer and a printing method thereof, and more particularly, to a handheld printer for detecting its accurate position using a sensor and a printing method thereof.

2. Description of the Related Art

General printers are connected to computers. It is difficult to transfer and carry them due to their great sizes. Since the general printers use a paper feeding method, they are limited to sheets of standard paper having predetermined sizes.

Movable printers have been distributed to develop miniature electronic devices and solve their problems as described above. Such a movable printer is classified into a special-purpose handheld printer and a general-purpose handheld printer. Examples of the special-purpose handheld printer include barcode, label, receipt, and icon printers, and so on. Each of the examples of the special-purpose handheld printers includes a data processor and a printing unit which are appropriate for a special purpose and are formed in a single body. Thus, the data processor installed in the special-purpose handheld printer generates data (e.g., barcodes, labels, receipts, or the like) which is to be printed, and the printing unit attached to the special-purpose handheld printer directly prints the generated data. Examples of the general-purpose handheld printer include a photo or general small printer, and so on. Each of the examples of the general-purpose handheld printer includes only a device which takes charge of printing. The general-purpose handheld printer receives data, which is to be printed, from a mobile device such as a personal digital assistant (PDA), a digital camera, a cellular phone, or the like and prints the data.

SUMMARY OF THE INVENTION

Exemplary embodiments of the present invention provide a handheld printer for detecting its accurate position using a sensor and a printing method thereof.

According to an aspect of the present invention, there is provided a handheld printer including: a distance information receiver which receives distance information from at least one sensor positioned outside the handheld printer; a position determiner which determines a position of the handheld printer based on the distance information; and a controller which determines data, which is to be printed, in the determined position.

The handheld printer may further include a printing area setter which sets a printable area based on the distance information, wherein the controller selects the data to be printed using the printable area and the determined position of the handheld printer.

The distance information may include first distance information indicating a distance between the at least one sensor and the handheld printer and second distance information indicating a distance which may be sensed by the at least one sensor, wherein the position determiner determines the position of the handheld printer based on the first distance information, and the printing area setter sets the printable area based on the second distance information.

The printing area setter may determine a printing area in which the data is to be printed, and the controller may select the data to be printed using the printing area and the determined position of the handheld printer.

According to another aspect of the present invention, there is provided a printing method performed in a handheld printer, including: receiving distance information from at least one sensor positioned outside the handheld printer; determining a position of the handheld printer based on the distance information; and determining data, which is to be printed, in the determined position.

According to another aspect of the present invention, there is provided a computer readable recording medium having embodied thereon a computer program for executing the method of a printing method performed in a handheld printer, the method including: receiving distance information from at least one sensor positioned outside the handheld printer; determining a position of the handheld printer based on the distance information; and determining data, which is to be printed, in the determined position.

BRIEF DESCRIPTION OF THE DRAWINGS

The above and other aspects of the present invention will become more apparent by describing in detail exemplary embodiments thereof with reference to the attached drawings in which:

FIG. 6 illustrates a pseudo code for performing a printing method in a handheld printer according to an embodiment of the present invention.

DETAILED DESCRIPTION OF EXEMPLARY EMBODIMENTS

The present invention will now be described more fully with reference to the accompanying drawings, in which exemplary embodiments of the invention are shown.

Figure 1:
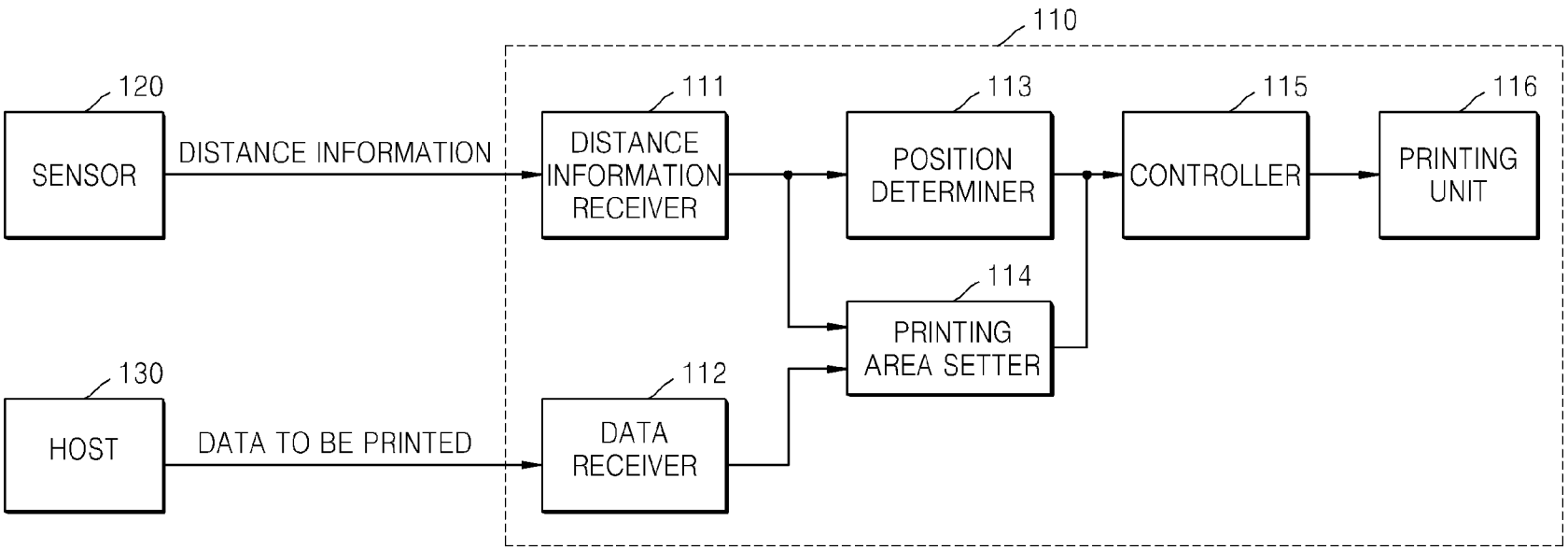
FIG. 1 is a block diagram of a handheld printer according to an exemplary embodiment of the present invention.

FIG. 1 is a block diagram of a handheld printer 110 according to an exemplary embodiment of the present invention. Referring to FIG. 1, the handheld printer 110 includes a distance information receiver 111, a data receiver 112, a position determiner 113, a printing area setter 114, a controller 115, and a printing unit 116.

A sensor 120 senses a distance between sensors or a distance between the sensors and the handheld printer 110. The sensor 120 also transmits information (hereinafter referred to as distance information) about the distance to the handheld printer 110. Alternatively, the sensor 120 may transmit only its position information to the handheld printer 110, and the handheld printer 110 may compute the distance information using the position information of the sensor 120. The sensor 120 may be an active or passive sensor. The number of sensors 120 is at least one or more but is not limited.

The distance information receiver 111 receives the distance information from the sensor 120 which is positioned outside the handheld printer 110. The distance information includes distance information about a distance which can be sensed by the sensor 120 and distance information about a distance between the sensors and the handheld printer 110. If a plurality of sensors be positioned outside the handheld printer 110, the distance information which can be sensed by the sensor 120 may be distance information about distances among the sensors.

Figure 2:
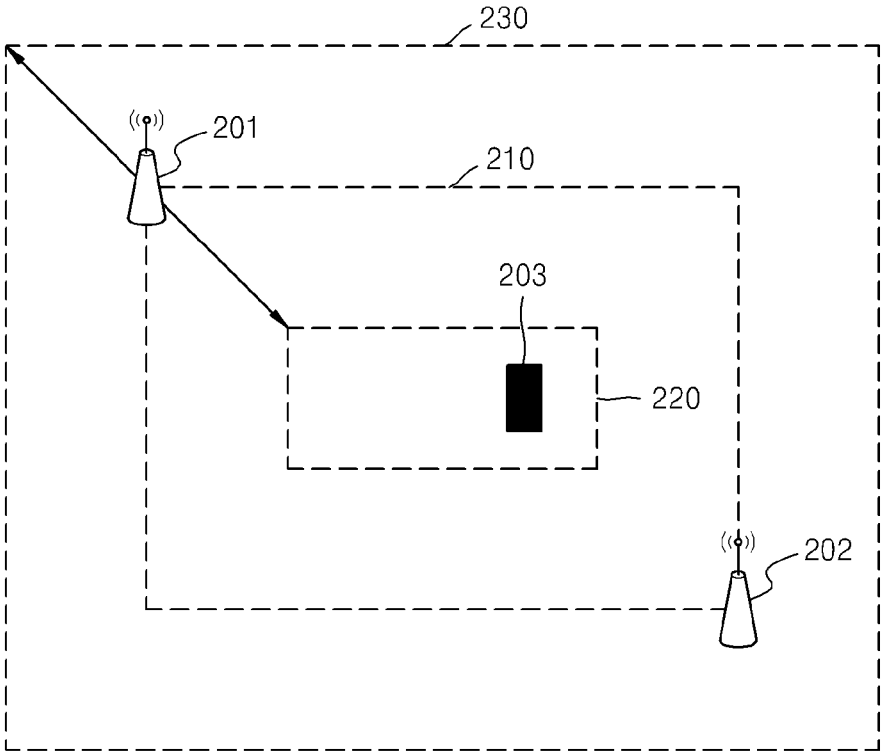
FIG. 2 illustrates a method of determining a position of a handheld printer and setting a printable area, according to an exemplary embodiment of the present invention.

The distance information will now be described with reference to FIG. 2. Referring to FIG. 2, distance information between sensors refers to distance information between first and second sensors 201 and 202, and distance information between sensors and a handheld printer refers to distance information between the first sensor 201 and a handheld printer 203 and distance information between the second sensor 202 and the handheld printer 203.

The position determiner 113 determines a position of the handheld printer 110 based on distance information between the sensor 120 and the handheld printer 110. If the sensor 120 is positioned within enough range to sense the handheld printer 110, the position determiner 113 may accurately detect the position of the handheld printer 110 even if the handheld printer 110 is placed in any position. Thus, even if the handheld printer 110 transfers to a random position, the position determiner 113 may receive information (hereinafter referred to as position information) about the position of the handheld printer 110 without loss of the position information.

Referring to FIG. 2 again, the position determiner 113 may accurately compute a position of the handheld printer 203 based on the distance information received from the first and second sensors 201 and 202. For example, the position determiner 113 may accurately compute the position of the handheld printer 203 using horizontal and vertical coordinates of the first sensor 201 and horizontal and vertical coordinates of the second sensor 202. However, the present invention is not limited to the above-described computing method, and if distance information is received from a sensor, the position of the handheld printer 203 may be computed using various methods.

The printing area setter 114 may set a printable area based on the distance information between the sensors. The printing area setter 114 may compute distances among the sensors to set a predetermined range in which the handheld printer 203 can perform printing, within a range which can be sensed by the sensors. Referring to FIG. 2, the printing area setter 114 sets a rectangular area 210 as a printable area based on a distance between the first and second sensors 201 and 202. The printing area setter 114 may set any range of printable area in which the accurate position of the handheld printer 203 can be computed, using the distance between the first and second sensors 201 and 202. According to an aspect of the present invention, the printing area setter 114 may change the printable area 210 into a reduced area 220 or an expanded area 230. Thus, limits to available media can be overcome.

The printing area setter 114 receives data, which is to be printed, from the data receiver 112 and determines a printing area in which the received data is to be printed, within the printable area depending on a relation between the received data and the printable area. The printing area is not equal to the printable area. The printing area is smaller than or equal to the printable area. The printing area setter 114 may set the printing area in any shape within the printable area. The printing area setter 114 may expand, reduce, or rotate the data to be printed in order to determine the printing area so as to print the data in the printing area. This will now be described with reference to FIGS. 3A through 3C and FIGS. 4A through 4C.

Figure 3A:
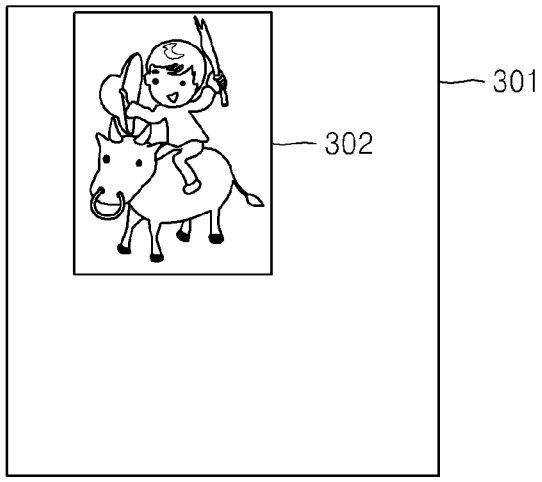
FIGS. 3A through 3C illustrate printing areas according to exemplary embodiments of the present invention.
Figure 3B:
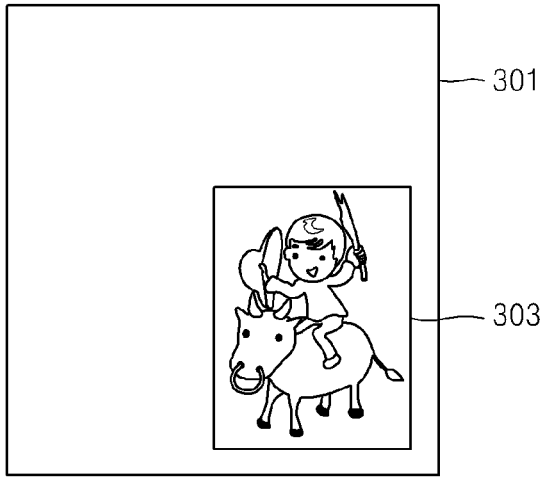
Figure 3C:
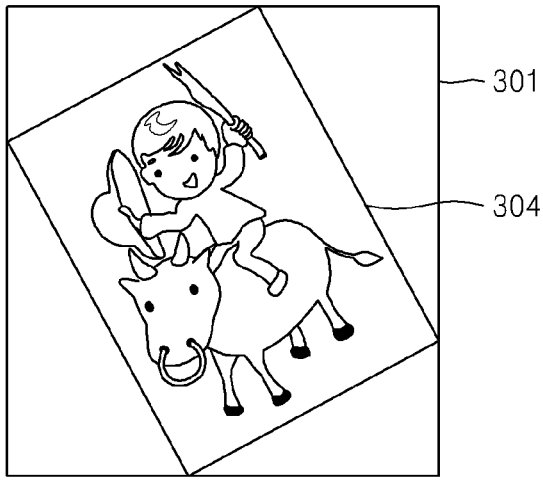

FIGS. 3A through 3C illustrate printing areas according to exemplary embodiments of the present invention. Referring to FIGS. 3A through 3C, printing areas 302, 303, and 304 in which data is to be printed are smaller than a printable area 301. The printing area 302 is determined at the left top of the printable area 301 in FIG. 3A, and the printing area 303 is determined at the right bottom of the printable area 301 in FIG. 3B. Thus, data is printed in the printing area 302 or 303. In FIG. 3C, the printing area 304 is slanted with respect to the printable area 301, and data is enlarged more than that printed in the printing areas 302 and 303 of FIGS. 3A and 3B and then printed in the printing area 304.

Figure 4A:
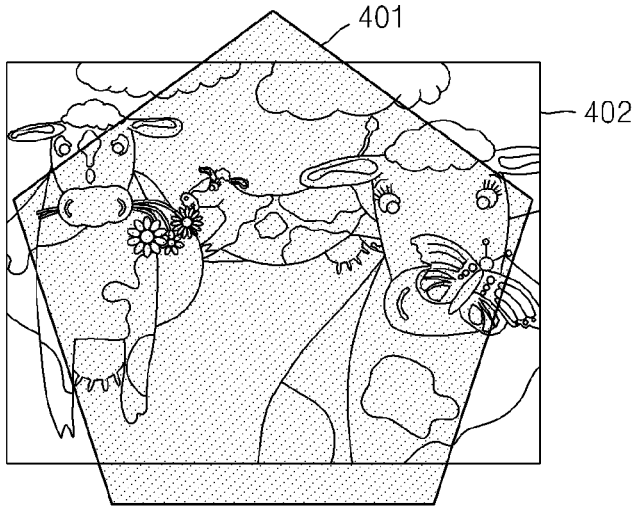
FIGS. 4A through 4C illustrate printing areas related to data, which is to be printed, according to exemplary embodiments of the present invention.
Figure 4B:
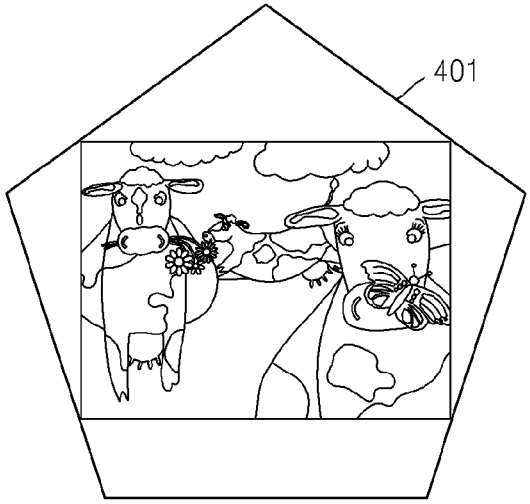
Figure 4C:
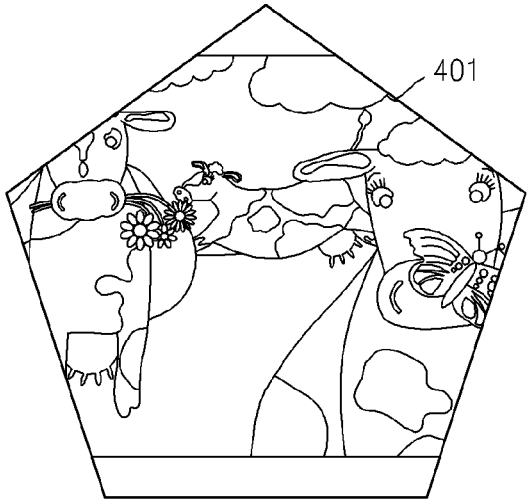

FIGS. 4A through 4C illustrate printing areas related to data to be printed according to exemplary embodiments of the present invention. In FIG. 4A, a pentagonal area 401 denotes a printable area, and a square image 402 denotes data which is to be printed. The printable area 401 is set by arranging a plurality of sensors (not shown) randomly. In FIG. 4A, the square image (i.e., original data) 402 is larger than the printable area 401. In FIG. 4B, original data is reduced and printed so that all of the original data is printed in a printable area 401. In FIG. 4C, original data is cut out to the printable area 401 and then printed in the printable area 401.

If the determined position of the handheld printer 110 is in the printable area, the controller 115 selects data to be printed. The printing unit 116 prints the selected data. The position of the handheld printer 110 may be determined based on the printing unit 116.

According to another aspect of the present invention, the distance information receiver 111 may receive only position information of sensors. In this case, the position determiner 113 may determine the position of the handheld printer 110 using only the position information of the sensors, and the printing area setter 114 may compute and determine a printable area and a printing area in which data is to be printed, using only the position information of the sensors.

Figure 5:
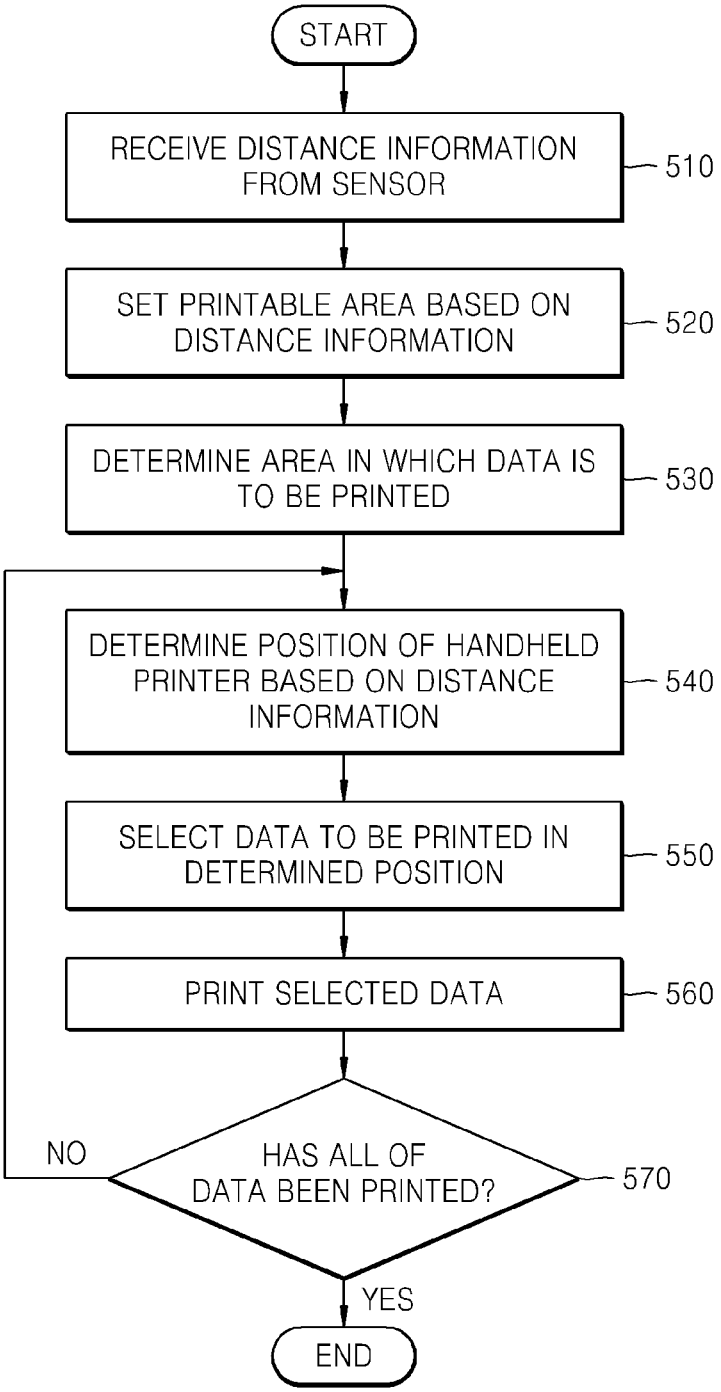
FIG. 5 is a flowchart of a printing method performed in a handheld printer, according to an exemplary embodiment of the present invention.

FIG. 5 is a flowchart of a printing method performed in a handheld printer, according to an exemplary embodiment of the present invention. Referring to FIG. 5, in operation 510, the handheld printer receives distance information from at least one sensor positioned outside the handheld printer. The distance information includes distance information about a distance which can be sensed by a sensor and/or distance information about a distance between sensors and the handheld printer. If a plurality of sensors are positioned outside the handheld printer, the distance information which can be sensed by a sensor can indicate distance information between the sensors. There can be one or more sensors, but this number is not limited.

In operation 520, the handheld printer sets a printable area based on the received distance information about the distance which can be sensed by the sensor. The handheld printer may compute a distance between the sensors to set a predetermined printable area within a range which can be sensed by the sensor. If an accurate position of the handheld printer can be detected within the range, the range is not limited regardless of the number of sensors. Therefore, according to an exemplary embodiment the present embodiment, limits to available media can be overcome.

In operation 530, the handheld printer determines a printing area in which data, which is to be printed, within the printable area depending on a relation between the received data and the printable area. The printing area is not equal to the printable area. The printing area is smaller than or equal to the printable area. The handheld printer may set the printing area in any shape within the printable area. The handheld printer may expand, reduce, or rotate the data to be printed to determine the printing area so as to print the data in the printing area.

In operation 540, the handheld printer determines its position based on the distance information between at least one sensor and the handheld printer. Therefore, if a sensor is positioned within enough range to sense the handheld printer, the position of the handheld printer may be accurately detected in any place. For example, if two sensors are positioned outside the handheld printer, the position of the handheld printer may be accurately computed using horizontal and vertical coordinates of the two sensors. However, exemplary embodiments of the present invention are not limited thereto. If distance information is received from a sensor, the position of the handheld printer may be computed using various methods. Thus, if the handheld printer transfers to a random position, position information of the handheld printer may be received without loss.

In operation 550, the handheld printer selects data, which is to be printed, in the determined position. If the determined position of the handheld printer is in the printing area, the handheld printer selects the data to be printed.

In operation 560, the handheld printer prints the selected data.

In operation 570, a determination is made as to whether all of the data has been printed. If it is determined in operation 570 that the all of the data has been printed, printing of the data is ended. If it is determined in operation 570 that the all of the data has not been printed, the process returns to operation 540 to re-determine the position of the handheld printer. For example, if the handheld printer transfers to another position during printing and thus position information is lost, the handheld printer receives new distance information from the sensor to re-determine its position. Thereafter, operations 550 through 570 are repeated.

According to another aspect of the present invention, the handheld printer may receive only position information of sensors. In this case, the handheld printer may determine its position, and compute and determine a printing area and a printing area in which data is to be printed, using only the position information of the sensors.

FIG. 6 illustrates a pseudo code for performing a printing method in a handheld printer according to an exemplary embodiment of the present invention. Referring to FIG. 6, "ConfigurationPrintingRegion( )" denotes a function for setting a printing area, and "PositionDetection( )" denotes a function for determining a position of a handheld printer. If printing is not completed, the position of the handheld printer is re-determined to perform printing according to an iterative statement.

The invention can also be embodied as computer readable codes on a computer readable recording medium. The computer readable recording medium is any data storage device that can store data which can be thereafter read by a computer system. Examples of the computer readable recording medium that are data storage devicesits include read-only memory (ROM), random-access memory (RAM), CD-ROMs, magnetic tapes, floppy disks, and optical data storage devices. The computer readable recording medium can also be distributed over network coupled computer systems so that the computer readable code is stored and executed in a distributed fashion. Also, functional programs, codes, and code segments for accomplishing the present invention can be easily construed by programmers skilled in the art to which the present invention pertains.

While this invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A handheld printer comprising:

a distance information receiver which receives distance information from at least one sensor positioned outside the handheld printer;

a position determiner which determines a position of the handheld printer based on the distance information; and a controller which determines data, which is to be printed, in the determined position.

2. The handheld printer of claim 1, further comprising a printing area setter which sets a printable area based on the distance information, wherein the controller selects the data to be printed using the printable area and the determined position of the handheld printer.

3. The handheld printer of claim 2, wherein the distance information comprises first distance information indicating a first distance between the at least one sensor and the handheld printer and second distance information indicating a second distance which can be sensed by the at least one sensor, wherein the position determiner determines the position of the handheld printer based on the first distance information, and the printing area setter sets the printable area based on the second distance information.

4. The handheld printer of claim 2, wherein the printing area setter determines a printing area in which the data is to be printed, and the controller selects the data to be printed using the printing area and the determined position of the handheld printer.

5. The handheld printer of claim 4, wherein the printing area is not equal to the printable area.

6. The handheld printer of claim 4, wherein the printing area is smaller than or equal to the printable area.

7. The handheld printer of claim 1, wherein the distance information comprises first distance information indicating a first distance between the at least one sensor and the handheld printer and second distance information indicating a second distance which can be sensed by the at least one sensor, and wherein the position determiner determines the position of the handheld printer based on the distance information received from the first and second sensors.

8. The handheld printer of claim 7, wherein the position determiner determines the position of the handheld printer based on horizontal and vertical coordinates of the first sensor and horizontal and vertical coordinates of the second sensor.

9. A printing method performed in a handheld printer, said printing method comprising:

receiving distance information from at least one sensor positioned outside the handheld printer;

determining a position of the handheld printer based on the distance information; and determining data which is to be printed in the determined position.

10. The printing method of claim 9, further comprising setting a printable area based on the distance information, wherein the data to be printed is selected using the printable area and the determined position of the handheld printer.

11. The printing method of claim 10, wherein the distance information comprises first distance information indicating a first distance between the at least one sensor and the handheld printer and second distance information indicating a second distance which can be sensed by the at least one sensor, wherein the position of the handheld printer is determined based on the first distance information, and the printable area is set based on the second distance information.

12. The printing method of claim 10, further comprising determining a printing area in which the data is to be printed, in the printable area, wherein the data to be printed is selected using the printing area and the determined position of the handheld printer.

13. A computer readable recording medium having embodied thereon a computer program for executing the method of a printing method performed in a handheld printer, the method comprising:

receiving distance information from at least one sensor positioned outside the handheld printer;

determining a position of the handheld printer based on the distance information; and determining data which is to be printed in the determined position.

* * * * *